US007744683B2

(12) United States Patent
Zhang

(10) Patent No.: US 7,744,683 B2
(45) Date of Patent: Jun. 29, 2010

(54) TRANSPARENT FILTERABLE DUST BAG WITH SUPPORT CONTAINER FOR VACUUM CLEANER

(76) Inventor: Yuejie Zhang, 7541 W. Lakeside Dr., Frankfort, IL (US) 60423-8667

( * ) Notice: Subject to any disclaimer, the term of this patent is extended or adjusted under 35 U.S.C. 154(b) by 547 days.

(21) Appl. No.: 11/738,602

(22) Filed: Apr. 23, 2007

(65) Prior Publication Data

US 2008/0257164 A1 Oct. 23, 2008

(51) Int. Cl.
*B01D 46/00* (2006.01)

(52) U.S. Cl. ..... 96/416; 15/347; 15/DIG. 8; 55/361; 55/365; 55/378; 55/381; 55/382; 55/DIG. 2; 96/415

(58) Field of Classification Search ..... 96/416, 96/414, 415, 316; 55/521, 361, 365, 378, 55/381, 382, DIG. 2; 15/304, 347, DIG. 8
See application file for complete search history.

(56) References Cited

U.S. PATENT DOCUMENTS

| | | | | | |
|---|---|---|---|---|---|
| 3,204,391 | A * | 9/1965 | Schwab | 55/374 |
| 4,015,959 | A * | 4/1977 | Grote | 96/136 |
| 4,072,483 | A * | 2/1978 | Doyle, Jr. | 55/372 |
| 4,105,420 | A | 8/1978 | Moore | |
| 4,229,193 | A * | 10/1980 | Miller | 55/318 |
| 5,090,976 | A * | 2/1992 | Dyson | 55/337 |
| 5,771,532 | A * | 6/1998 | Munnoch | 15/352 |
| 5,935,279 | A | 8/1999 | Kilstrom | |
| 6,149,995 | A * | 11/2000 | Peiffer et al. | 428/35.8 |
| 6,210,457 | B1 * | 4/2001 | Siemers | 55/429 |
| 6,256,834 | B1 | 7/2001 | Meijer et al. | |
| 6,743,497 | B2 * | 6/2004 | Ueda et al. | 428/73 |
| 6,989,039 | B2 * | 1/2006 | Vuijk | 55/343 |
| 7,341,612 | B2 * | 3/2008 | Nhan et al. | 55/373 |
| 2002/0022422 | A1 * | 2/2002 | Waldrop et al. | 442/179 |
| 2003/0188398 | A1 * | 10/2003 | Bathey | 24/30.5 R |
| 2004/0221416 | A1 * | 11/2004 | Ritter | 15/347 |
| 2005/0183232 | A1 * | 8/2005 | Wright et al. | 15/347 |

* cited by examiner

*Primary Examiner*—Duane Smith
*Assistant Examiner*—Thomas Bennett McKenzie

(57) ABSTRACT

The removable apparatus of a transparent filterable dust bag with a support container is designed as an attachment for a vacuum cleaner and like. A transparent filterable dust bag having an outer transparent wall and an inner filter cone coincides within a transparent support container which keeping the shape and position of the dust bag while separating dust from air. The transparent support container and the outer transparent wall of the dust bag allow to watch inside the filling level of the dust bag and to replace properly.

5 Claims, 1 Drawing Sheet

TRANSPARENT FILTERABLE DUST BAG WITH SUPPORT CONTAINER FOR VACUUM CLEANER

TECHNICAL FIELD AND INDUSTRIAL APPLICABILITY OF THE INVENTION

The present invention relates to an attachment for a vacuum cleaner and like, more particularly to a unique structural arrangement for seeing through a dust filter bag widely and better retaining a flexible transparent filterable dust bag in a designed working position inside a support container during separating dust from air.

BACKGROUND OF THE INVENTION

Collection equipments for separating dust, dirt and similar material from air, such as vacuum cleaners, require the use of filter, dust bags or containers for the material to be filtered and collected.

Theses conventional dust bags combine the functions of filtering and collecting. They can consist of paper, or any other filtration type material which on the one hand allows to collect dust and dust-like material and on the other hand has a porosity sufficient for the fluid carrying the dust or dust-like material with a minimum pressure drop. They are light and flexible.

Typically these dust bags are provided with an intake opening through which the dust or dust-like particles is to be transported and collected within the bags. The dust or dust-like material is packed into a bag and then the filled bag is disposed. A dust bag minimizes opportunities to contact collected dust by hand directly. A filter material is opaque normally to prevent people from watching the filling situation of dust bag directly. As long as the accumulation of dust, some methods are necessary to measure when it is time to replace the filled bag. In all of known filterable bag designs the replacing of filled bag is dependent on pressure differences measured.

The bag-less technology separates the functions of collecting and filtering. Normally a durable filter or a cyclone device is used to filter dust air and dirt, and trap dust and dirt in a surrounding transparent container. These containers can be made from strengthened plastic, or any other strengthened lighter and transparent type container material. Dirt and dust are seen and then a filled transparent container will be picked out of position from a vacuum cleaner. These filters can consist of paper, or any other filtration type material which form airflow path and trap dust. The cyclone separating technology has the advantage of collecting coarse particle and a disadvantage on filtering fine particles. A conventional filter can be combined into a cyclone type cleaner for increasing the capacity of collecting fine particles. Durable filters or washable filters are to be cleaned or replaced in a designed long period in most of bag-less vacuum cleaner. Sooner or later there still are some opportunities to touch dirty filters directly.

A need is identified for a way to retain the advantages of flexible filterable bags and transparent bag-less containers; and to reduce the disadvantages affection of no transparent filterable material and touching dirty durable filters.

SUMMARY OF THE INVENTION

It is an object of the present invention to watch dust collecting process visually and to replace a filled dust bag properly without touching dirt. This object is solved by a transparent filterable dust bag with a support container according to the following description: An apparatus for use in a vacuum cleaner and like, comprising: a disposable, flexible transparent filterable dust bag comprising an airtight flexible outer transparent pocket part, an air permeable inner filter part, and reinforcement rings; and a support container comprising a transparent cup and an inner cone for matching a supporting the dust bag and guiding air flow, wherein the dust bag has a "W" shaped cross section, the outer transparent pocket part of the dust bag is made of a flexible, transparent, plastic package film material and wherein the bottom of the inner filter part of the dust bag overlaps and seals against the bottom of the outer transparent pocket part of the dust bag to form the dust bag.

According to the invention a transparent filterable dust bag for collecting dust-like material equipments, particularly for vacuum cleaners, with two opposing wall parts of an inner opaque filter material and an outer transparent package material cylinder with an top intake opening is provided, wherein the bottoms of two wall parts are connected to each other to form a "W" shape cavity. The cavity provides an airflow path and traps dust and dirt.

The inner filter part of the dust bag according to the invention can be made of filtering materials selected from the group comprising paper, synthetic material as known to someone skilled in the art. It provides an airflow path and trap dust.

The outer transparent pocket part of the dust bag according to the invention can be made of a package material selected from the group flexible transparent ethylene vinyl acetate, polyethylene, poly-nylon, plastic films as known to someone skilled in the art.

The dust bag comprises airtight part of the outer transparent pocket and permeable part of the inner filter. The suction force intends to attract inside of the flexible outer transparent pocket close to the inner filter part. For keeping the opening of the transparent filterable dust bag, the present invention comprise strengthening the dust bag by reinforcement rings, overlapping the bottoms of the inner filter part and outer transparent pocket part, having opposite suction force from the outside of the flexible outer transparent pocket by adding air chamber ribs on the wall of the transparent cup of the support container.

The reinforcement rings of the dust bag according to the invention can be made from a group of plastic material as known to someone skilled in the art. It is against suction force to reinforce the opening of the cavity of the dust bag.

According to the invention a support container for housing the dust bag comprises an inner cone and a transparent cup. The support container coincides with the dust bag for keeping the opening dust bag in a designed working position and having airflow path to the outlet of a vacuum cleaner like.

The inner cone of the support container according to the invention can be made from the group of plastic material as known to someone skilled in the art. The inner cone coincides with the inner filter part of the dust bag for keeping the shape and position of the inner filter part. Many holes are made in the wall of the cone for providing an airflow path.

The transparent cup of the support container according to the invention can be made from the group strengthened transparent plastic material as known to someone skilled in the art. The transparent cup coincides with the outer transparent pocket part for keeping the shape and position of the outer transparent pocket part. There are a few of air chamber ribs on the wall in which numbers of holes are made for conducting inside of the transparent cup to the outlet of a vacuum cleaner. The suction force from chamber ribs attracts outside of the outer transparent pocket of the dust bag against opposite suction force from the inner filter part and the inner cone. Chamber ribs and the inner cone are conducted to the outlet of a vacuum cleaner like.

The transparent filterable dust bag is set on the support container. An opening inlet receives dust air and dirt following into the bag. Dust and dirt are collected in the dust bag and cleaned air flows into the inner cone of the support container. The combined functions of the reinforcement rings and air chamber ribs of the transparent cup keep the dust bag in designed shape and position. Looking through the transparent cup of the support container and the outer transparent pocket of the dust bag, a filling level of the dust bag is identified visually. The filled dust bag is taken from the cavity of the support container by pulling the edge of the dust bag from the flange of the support container. Collected dust and dirt always be kept inside of the transparent filterable dust bag without exposing to air.

IN THE DRAWINGS

Hereinafter are described preferred embodiments of the transparent filterable dust bag, the support container of the apparatus according to the invention.

Figure 1:
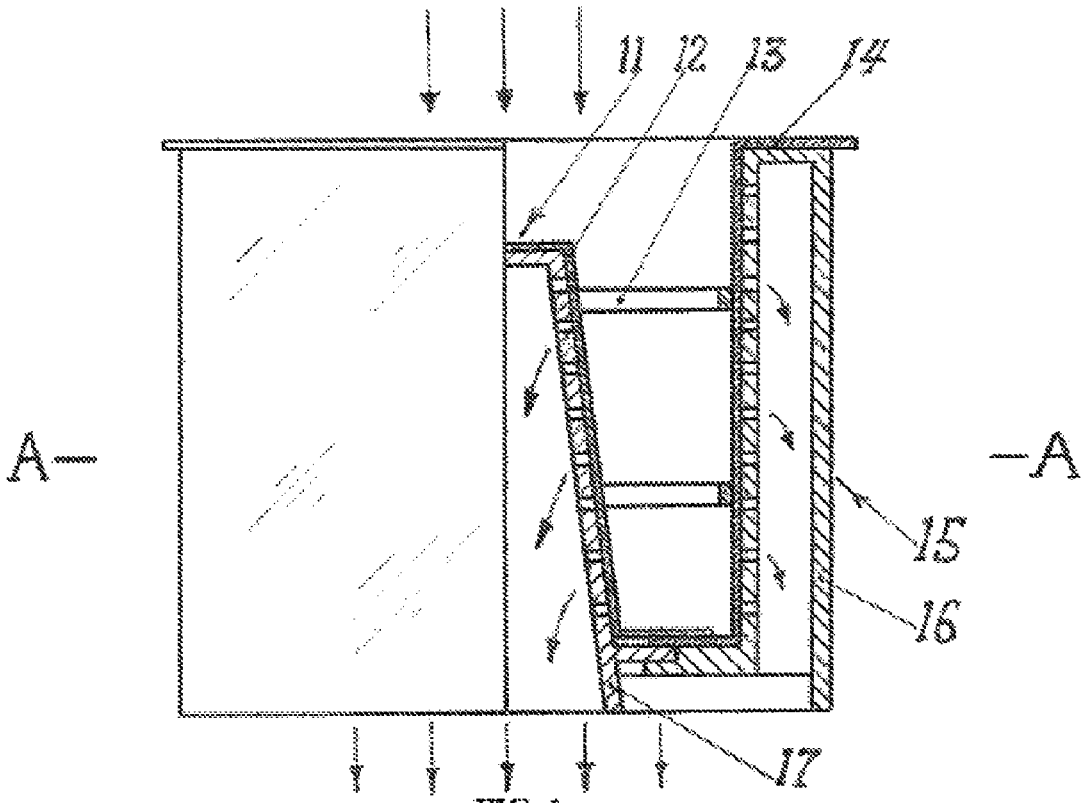
FIG. 1 is a half cross-section view of an apparatus of the transparent filterable dust bag 11 with the support container 15 utilizing my present invention.

| Reference Numerals | |
|---|---|
| 11 A transparent filterable dust bag | 12 Inner filter part |
| 13 Reinforce rings | 14 Outer transparent pocket part |
| 15 A support container | 16 A transparent cup |
| 17 An inner cone | |

DETAILED DESCRIPTION OF THE INVENTION

The present invention can be applied generally in a vacuum cleaner like; in the exemplary embodiment described hereinafter, the invention will be explained with the reference to an apparatus of a transparent filterable dust bag 11 with a support container 15 illustrated in FIG. 1 and FIG. 2.

A dust bag, embodying the principles of my invention, is shown generally at 11 and is set on the support container 15. A support container, embodying the principles of my invention is shown generally at 15 and will be mounted on a vacuum cleaner and like.

Figure 2:
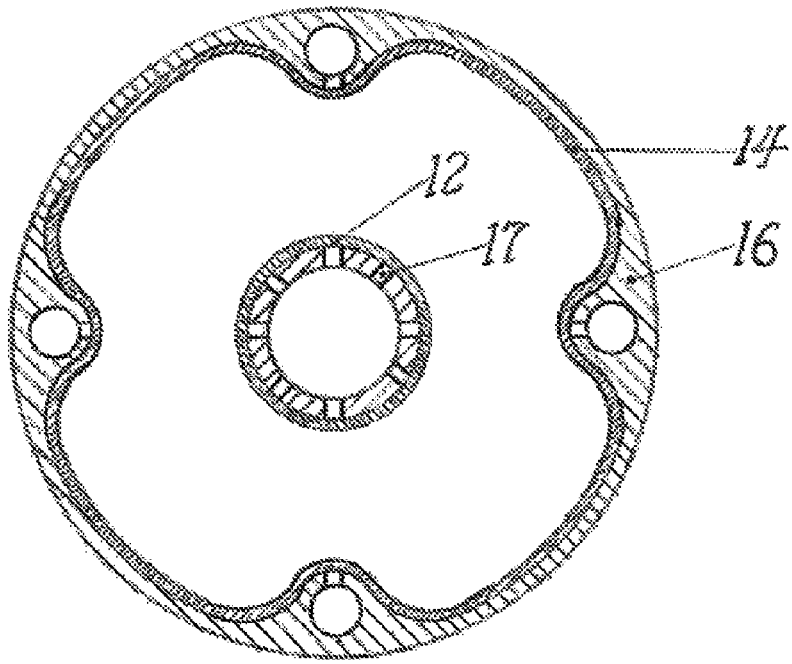
FIG. 2 is a cross-sectional view taken along the line A-A in FIG. 1.

The transparent filterable dust bag 11 is illustrated in FIG. 1. The dust bag 11 comprises an inner filter part 12, an outer transparent pocket part 14, and reinforcement rings 13 shown in FIG. 1 and FIG. 2. The support container 15 is illustrated in FIG. 1. The support container 15 includes an inner cone 17 and a transparent cup 16 shown in FIG. 1 and FIG. 2.

The inner filter part 12 and outer transparent pocket part 14 form a cross section "W" shaped cavity that is open to the dust air inlet for collecting dust. The inner filter part 12 is made of filterable material. This filterable material is one or a combination of paper, synthetic material as known to someone skilled in the art. The inner filter part 12 is air permeable to form an air outlet. The inner filter part 12 has a substantially cone shape that will benefit to be removed from the support container 15. The inner filter part 12 coincides with the inner cone 17 of the support container 15. The bottom of the inner filter part 12 overlaps the bottom of the outer transparent pocket part 14 for sealing together and strengthening. The outer transparent pocket part 14 is made of flexible transparent plastic package film material as know to someone skilled in the art. The outer transparent pocket part 14 is transparent for watching inside of the dust bag. The outer transparent pocket part 14 has a cylindrical shape and coincides with the transparent cup 16 of the support container 15. The suction force from the inner filter part 12 intends to attract the flexible transparent pocket part 14. The reinforcement rings 13 are attached to the outer transparent pocket part 14 to increase the strength of the outer transparent pocket 14 and maintain the opening of the dust bag 11. The reinforcement rings 13 have a cycle shape and coincide with the outer transparent pocket 14. The reinforcement rings 13 are made of plastic material.

The inner cone 17 has a substantially cone shape and is made of plastic material. There are many holes on the wall of the inner cone 17 to form an airflow path for the inner filter part 12. The inner cone 17 supports the inner filter part 12 and keep the shape of the inner filter part 12 in a designed position. The transparent cup 16 is made of transparent plastic material for supporting the dust bag 11 and providing a wide watching window. There are chamber ribs on the wall of the transparent cup 16. These chamber ribs conduct to the discharge outlet to form additional airflow paths. Some holes are made on the chamber ribs to compensate the suction force from the central side of inner filter part 12 and inner cone 17. The combination of the reinforce rings 13 and the chamber ribs of the transparent cup 16 prevent the dust bag 11 from waving and turning in the support container 15.

As described above, dust and dirt air is sucked into the opening cavity of the transparent filterable dust bag 11 and then dust and dirt are separated from drawn-in air and trapped in the W shape cavity of the dust bag 11. Clean air passes through inner part 12 and then is drawn into the inner cone 17 of the support container 15 and discharged to the outlet of a vacuum cleaner. By seeing through the transparent cup 16 and the outer transparent pocket 14, a filling status is identified visually. The filled apparatus of a transparent filterable dust bag 11 and a support container 15 is moved out from a vacuum cleaner. By pulling out the transparent filterable dust bag 11 from the support container 15, folding the transparent filterable dust bag 11, and throwing the transparent filterable dust bag 11 into a garbage bin, no collected dust and dirt are exposed during the process of replacing the transparent filterable dust bag 11. A transparent filterable dust bag 11 is a replaceable and consumable product. A support container 15 is a removable and durable device.

As described above, dust and dirt air is sucked into the opening cavity of the transparent filterable dust bag 11 and then dust and dirt are separated from drawn-in air and trapped in the W shape cavity of the dust bag 11. Clean air pass through inner part 12 and then is drawn into the inner cone 17 of the support container 15 and discharge to the outlet of a vacuum cleaner. By seeing through the transparent cup 16 and the outer transparent pocket 14, a filling status is identified visually. The filled apparatus of a transparent filterable dust bag 11 and a support container 15 is moved out from a vacuum cleaner. By pulling out the transparent filterable dust bag 11 from the support container 15, folding the transparent filterable dust bag 11, and throwing the transparent filterable dust bag 11 into a garbage bin, no collected dust and dirt are exposed during the process of replacing the transparent filterable dust bag 11. A transparent filterable dust bag 11 is a replaceable and consumable product. A support container 15 is a removable and durable device.

What is claimed is:

1. An apparatus for use in a vacuum cleaner and like, comprising:

a disposable, flexible transparent filterable dust bag comprising an airtight flexible outer transparent pocket part, an air permeable inner filter part, and reinforcement rings; and a support container comprising a transparent cup and an inner cone for matching a supporting the dust bag and guiding air flow, wherein the dust bag has a "W" shaped cross section, the outer transparent pocket part of the dust bag is made of a flexible, transparent, plastic package film material and wherein the bottom of the inner filter part of the dust bag overlaps and seals against the bottom of the outer transparent pocket part of the dust bag to form the dust bag.

2. The apparatus as claimed in claim 1, wherein the inner filter part of the dust bag comprises filter material.

3. The apparatus as claimed in claim 1, wherein the inner filter part of the dust bag has a substantially cone shape.

4. The apparatus as claimed in claim 1, wherein the reinforcement rings of the dust bag coincide with and strengthen the outer transparent pocket part of the dust bag.

5. The apparatus as claimed in claim 1, wherein the transparent cup of the support container has substantially chambered ribs.

* * * * *